US007454827B2

(12) United States Patent
Brown et al.

(10) Patent No.: US 7,454,827 B2
(45) Date of Patent: Nov. 25, 2008

(54) THREADED PEDESTAL CUP

(75) Inventors: Thomas J. Brown, Geneva, IL (US); Gary T. Mayberry, Elgin, IL (US)

(73) Assignee: Cap and Seal Company, Inc., Elgin, IL (US)

( * ) Notice: Subject to any disclaimer, the term of this patent is extended or adjusted under 35 U.S.C. 154(b) by 288 days.

(21) Appl. No.: 10/979,522

(22) Filed: Nov. 2, 2004

(65) Prior Publication Data

US 2005/0091827 A1 May 5, 2005

Related U.S. Application Data

(60) Provisional application No. 60/516,673, filed on Nov. 3, 2003.

(51) Int. Cl.
*B23P 11/00* (2006.01)
*B65D 41/04* (2006.01)

(52) U.S. Cl. ..... 29/506; 29/512; 29/557; 29/505; 220/626; 220/288; 220/619; 222/542; 222/402.1; 222/394; 413/62

(58) Field of Classification Search ..... 29/505, 29/506, 512, 557; 220/626, 528, 288, 361, 220/362, 600, 619; 72/379.4, 365.2; 222/542, 222/402.1, 393; 53/488; 413/62
See application file for complete search history.

(56) References Cited

U.S. PATENT DOCUMENTS 3,722,759 A * 3/1973 Rodden ..... 222/396
4,098,220 A * 7/1978 Yuhas ..... 116/106
4,207,287 A * 6/1980 Lindquist ..... 422/33
4,466,838 A * 8/1984 Heeb et al. ..... 106/311
4,515,285 A 5/1985 Euscher-Klingenhagen et al.
4,792,067 A 12/1988 Greenebaum, II
4,813,576 A 3/1989 Greenebaum, II
4,958,757 A * 9/1990 Greenebaume, II ..... 222/394
5,035,106 A * 7/1991 Haase ..... 53/470
5,285,916 A * 2/1994 Ross ..... 220/89.1
5,881,929 A * 3/1999 Coerver, Jr. ..... 222/402.1
6,070,770 A * 6/2000 Tada et al. ..... 222/635
6,802,461 B2 * 10/2004 Schneider ..... 239/337
2004/0108331 A1 * 6/2004 Smith et al. ..... 222/1
2005/0092755 A1 * 5/2005 Brown et al. ..... 220/581
2006/0278644 A1 * 12/2006 Baughman ..... 220/304

FOREIGN PATENT DOCUMENTS

WO WO 01/96208 A1 * 12/2001

* cited by examiner

*Primary Examiner*—Essama Omgba
(74) *Attorney, Agent, or Firm*—McAndrews, Held & Malloy, Ltd.

(57) ABSTRACT

A method for forming a threaded pedestal cup including providing a pedestal with an interior cavity having an inner surface, and a top portion that has a larger diameter than a bottom portion; inserting a non-threaded arbor into the interior cavity to engage the inner surface of the bottom portion; and engaging the outer surface with a threading tool, wherein the engaging includes deforming the metal into threads.

29 Claims, 3 Drawing Sheets

THREADED PEDESTAL CUP

RELATED APPLICATIONS

This application is related to, and claims priority from, Provisional Application No. 60/516,673, filed Nov. 3, 2003, titled "Threaded Laminated Cup," the complete subject matter of which is incorporated herein by reference in its entirety.

BACKGROUND OF THE INVENTION

The present invention relates to a threaded pedestal refrigerant cup, or threaded pedestal aerosol mounting cup, for use with a container carrying pressurized contents. The present invention also relates to a process for making such a threaded cup.

Pressurized liquids and gases, such as aerosols or refrigerants for example, are often stored and sold in small containers that are sealed with a mounting or refrigerant cup about the container neck. The conventional cup is formed from metal and has a substantially flat base with a peripheral rim having a skirt being integrally connected to the base by an outer wall. The cup further includes a cylindrical pedestal formed within a central area. During cup assembly, a plastic or rubber sealing material such as a gasket is placed within the peripheral rim of the cup between the outer wall and the skirt to sealingly engage the peripheral rim of the cup and the neck of the container. During the cup forming process, the pedestal is threaded such that a user may mount a corresponding threaded device on the pedestal to dispense the contents for an appropriate use. Once the cup is fully formed and assembled, the cup is positioned on the container. The container is then filled under the cup, or through a valve, or through the bottom of the container, by methods known in the art. The cup is sealed to the container by a crimping or clinching process known in the art.

A few different processes have historically been used to thread the pedestals of conventional cups. FIGS. 1 and 2 illustrate one method that has been used to thread a cup pedestal. FIG. 1 illustrates a sectional side view of a conventional steel pedestal 14*a* and a cylindrical arbor 26*a* having threads 28*a*. The arbor 26*a* is positioned to be inserted into the pedestal 14*a*. The pedestal 14*a* has a cavity 17*a*, an inner surface 18*a*, and an outer surface 22*a*. During the threading process, the pedestal 14*a* is threaded on both the inner surface 18*a* and the outer surface 22*a* simultaneously using offset matching threading devices. For example, the threaded arbor 26*a* is inserted into the pedestal cavity 17*a* and the threads 28*a* on the threaded arbor 26*a* machine the inner surface 18*a* as the outer surface 22*a* is simultaneously machined by any number of threading methods known in the art such as by a threaded arbor, rollers, wheels, threaded bars, etc.

FIG. 2 illustrates a sectional side view of an assembled cup 10*a* after the pedestal 14*a* has been threaded and a gasket 12*a* has been joined to the cup 10*a*. As shown, the threaded arbors operate to deform the pedestal 14*a* such that a rolled thread 30*a* with a nearly even thickness extends throughout the threaded area.

However, the process of FIGS. 1 and 2 suffers from a drawback. Using a threaded interior arbor 26*a* with another exterior threading tool to thread the pedestal 14*a* involves lengthy set-up time and some significant maintenance of the tooling. Also, perfect alignment of the interior arbor and the exterior threading tool must be maintained or the threads will be damaged.

FIGS. 3 and 4 illustrate another method that has been used to thread a cup pedestal. FIG. 3 illustrates a side sectional view of a conventional steel pedestal 14*b* with a non-threaded arbor 26*b* being positioned to be inserted into the pedestal 14*b*. During the threading process, the pedestal 14*b* is threaded on the outer surface 22*b* by inserting the non-threaded arbor 26*b* into the pedestal cavity 17*b* so that it engages the inner surface 18*b* while forming a thread on the outer surface 22*b* by an exterior threading tool known in the art.

FIG. 4 illustrates a side sectional view of the assembled cup 10*b* after the pedestal 14*b* has been threaded. As shown, the threading process produces a rolled thread 30*b* with a non-uniform thickness. This threading method leaves a smooth inner surface 18*b* of the pedestal 14*b*. Using the non-threaded arbor 26*b* results in lower tooling costs, easier set-up, and lower maintenance costs.

However, the process of FIGS. 3 and 4 suffers from drawbacks. For example, during the process, the metal is squeezed or extruded between the exterior threading tool and the non-threaded arbor 26*b* such that the metal has a non-uniform thickness along the threaded area. The thread 30*b* extends to an outer diameter 34 where the metal is thicker and to an inner diameter 38 where the metal is thinner. If a deeper thread is attempted, more stress and work hardening occurs during the threading process and the thread 30*b* can be weakened or broken. Work hardening is an increase in metal hardness that accompanies plastic deformation of the metal. Therefore, the speed of the thread rolling process is limited and the working life of the exterior threading tool is limited. Additionally, because the threading process results in non-uniform metal thickness over the threaded area, thicker raw material is necessary to accommodate certain thread depths.

Another threading process is disclosed in U.S. Pat. No. 4,515,285 issued to Euscher-Klingenhagen and shown in FIG. 5. The cup 10*c* is made from two thin layers of metal 42 and 46 sandwiched and then formed together as if they are one piece of metal. A non-threaded arbor is inserted into the pedestal 14*c* to engage the inner layer 46 while the outer layer 42 is threaded by an exterior threading tool known in the art. Only the outer layer 42 is threaded while the inner layer 46 remains generally intact. Because the inner layer 46 is not threaded, it does not break if the threaded outer layer 42 gets stripped or broken. This system of separate layers serves as a safety feature for containers carrying flammable contents because the inner layer 46 does not break even if the threaded outer layer 42 does.

However, the two metal layer process suffers from drawbacks as well. For example, the process is expensive, requires a separate gasket for use with the cup, and because the outer layer is so thin, the thread depth is extremely limited.

Therefore, a need exists for a thin threaded pedestal cup and a method for threading such a cup that overcomes the deficiencies of conventional cups and threading processes.

BRIEF SUMMARY OF THE INVENTION

Certain embodiments of the present invention include a method for forming a threaded laminated cup for use in sealing a container. This method includes forming a pedestal of a cup, wherein the forming comprises providing the pedestal with a first plastic laminated layer and second metal layer, an interior cavity having an inner surface, and a top portion that has a larger diameter than a bottom portion. The process further includes inserting a non-threaded arbor into the interior cavity to engage the first layer along the inner surface of the bottom portion. The process further includes engaging the second layer with a threading tool, wherein the engaging includes deforming the metal of the second layer into threads and compressing the plastic laminate of the first layer between the threads and the non-threaded arbor such that the second layer maintains a generally uniform thickness along the threads.

Certain embodiments of the present invention include a laminated cup for use in sealing a container. The cup includes a base having a pedestal and an outer wall extending from the base. The pedestal defines an interior cavity with an inner surface and has a first layer and a second layer. The pedestal is formed of a plastic laminated metal material such that the first layer is plastic laminate and the second layer is metal. The pedestal has a top portion and a bottom portion. The top portion has a larger diameter than the bottom portion. The pedestal is threaded by inserting a non-threaded arbor into the interior cavity to engage the first layer along the inner surface and engaging the second layer with a threading tool such that the metal of the second layer is deformed into threads and the plastic laminate of the first layer is compressed between the threads and the non-threaded arbor. The second layer maintains a generally uniform thickness at the threads and the inner surface along the top and bottom portions is non-threaded after being engaged by the threading tool.

Certain embodiments of the present invention include a method for forming a threaded laminated cup for use in sealing a container. The method further includes forming a pedestal of a cup, wherein the forming step includes providing the pedestal with a first plastic laminated layer and second metal layer, an interior cavity having an inner surface and a top wall, and a top portion that has a larger diameter than a bottom portion. The method further includes inserting a non-threaded arbor into the interior cavity to engage the first layer along the top wall and the inner surface at the bottom portion. The method further includes engaging the second layer with a threading tool. The engaging step includes moving the threading tool about the second layer to deform the metal of the second layer into threads and compressing the plastic laminate of the first layer into gaps formed between the threads and the non-threaded arbor such that the first layer allows the second layer to be deformed by the threading tool and maintain a generally uniform thickness along the threads while the inner surface along the top and bottom portions remains non-threaded.

Certain embodiments of the present invention include a method for forming a threaded cup for use in sealing a container. The method includes forming a pedestal of a cup, wherein the forming comprises providing the pedestal with an inner surface and an outer surface, a metal layer, an interior cavity and a top portion that has a larger diameter than a bottom portion. The method further includes inserting a non-threaded arbor into the interior cavity to engage the inner surface along the bottom portion. The method further includes engaging the outer surface with a threading tool, wherein the engaging comprises deforming the metal layer into threads, such that the metal layer maintains a generally uniform thickness along the threads.

Certain embodiments of the present invention include a cup for use in sealing a container. The cup includes a base having a pedestal and an outer wall extending therefrom. The pedestal has an inner surface and an outer surface and defines an interior cavity and has a metal layer. The pedestal has a top portion and a bottom portion and the top portion has a larger diameter than the bottom portion. The pedestal is threaded by inserting a non-threaded arbor into the interior cavity to engage the inner surface and engaging the outer surface with a threading tool such that the metal layer is deformed into threads. The metal layer maintains a generally uniform thickness at the threads.

Figure 1:
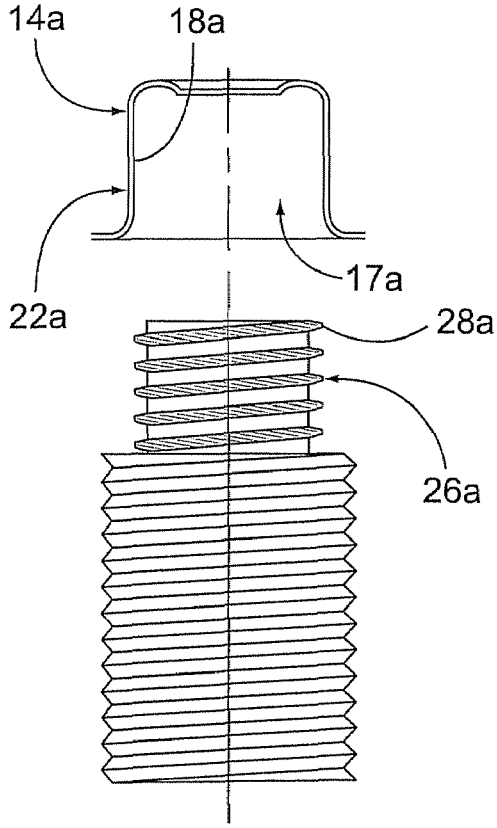
FIG. 1 (Prior Art)
FIG. 1 illustrates a side sectional view of a prior art pedestal and threaded arbor.
Figure 2:
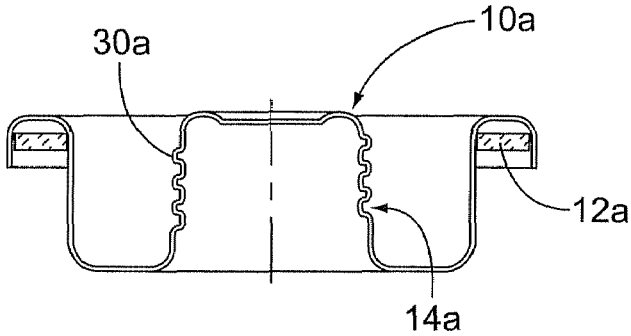
FIG. 2 (Prior Art)
FIG. 2 illustrates a side sectional view of a prior art cup after threading.
Figure 3:
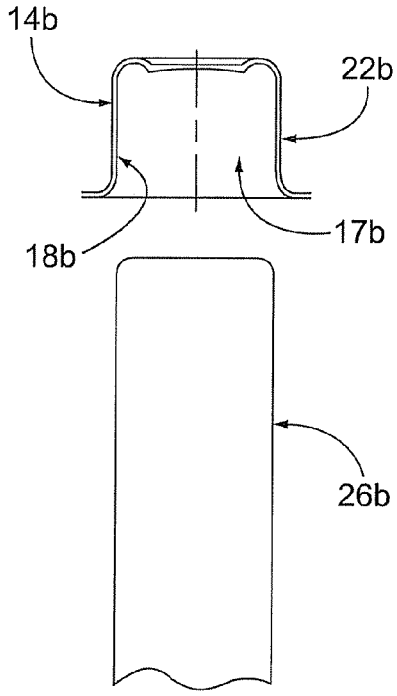
FIG. 3 (Prior Art)
FIG. 3 illustrates a side sectional view of a prior art pedestal and non-threaded arbor.
Figure 4:
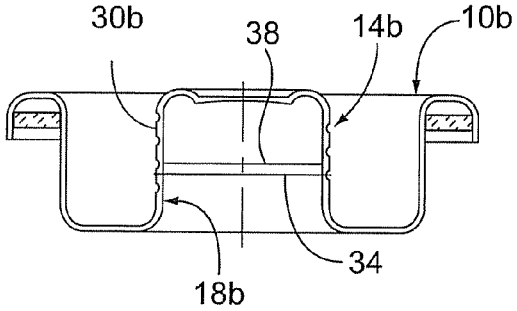
FIG. 4 (Prior Art)
FIG. 4 illustrates a side sectional view of a prior art cup after threading.
Figure 5:
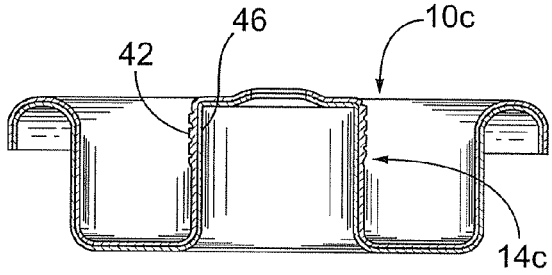
FIG. 5 (Prior Art)
FIG. 5 illustrates a side sectional view of a prior art cup.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Figure 6:
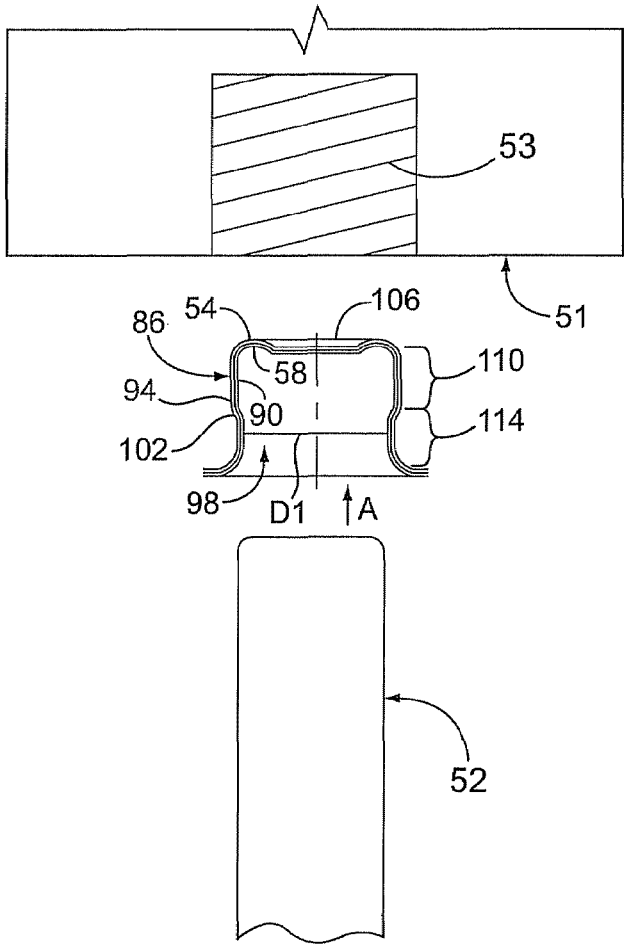
FIG. 6 illustrates a side sectional view of a laminated pedestal, a portion of a non-threaded arbor, and a portion of an exterior threading tool according to an embodiment of the present invention.
Figure 7:
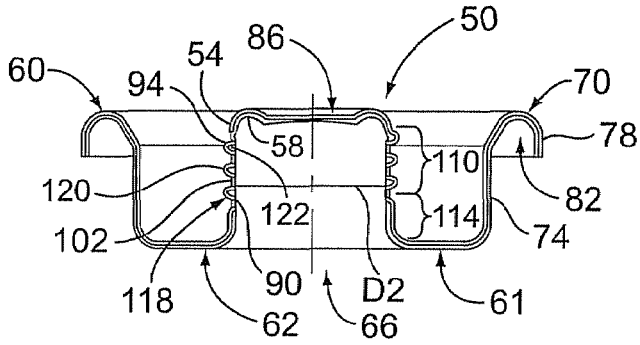
FIG. 7 illustrates a side sectional view of a laminated cup according to an embodiment of the present invention.

FIG. 6 illustrates a side sectional view of a laminated pedestal 86, a portion of a cylindrical smooth-surfaced, or non-threaded, arbor 52, and a portion of an exterior threading tool 51 according to an embodiment of the present invention. Alternatively, the pedestal 86 may be non-laminated metal. The pedestal 86 includes a side wall 102 and top wall 106 having a first or inner surface 90 and a second or outer surface 94 that define an interior cavity 98 of the pedestal 86. The side wall 102 of the pedestal 86 has a top portion 110 formed integrally with a bottom portion 114. The top portion 110 has a greater diameter than the bottom portion 114 and the diameter of the top portion 110 may be larger than conventional pedestal diameters prior to threading. Thus, the reduced bottom portion 114 expands outward to the wider top portion 110, but the thickness of the side wall 102 remains generally the same at both the top and bottom portions 110 and 114. For example, the thickness of the side wall 102 may vary within a range of 0.0009 inches along the top and bottom portions 110 and 114. The difference between the upper and lower diameters may vary according to the depth, pitch, and pitch diameter of the thread to be formed on the pedestal 86. The more metal that is displaced during the threading process, the larger the difference desired between that inner and outer diameter. By way of example, the bottom portion 114 has an inner diameter D1 across the interior cavity 98 along the inner surface 90 that is approximately equal to the desired inner diameter D2 across the interior cavity 98 along the inner surface 90 of the pedestal 86 at the finished threads 118 (FIG. 7). For example, the inner diameter D2 of the pedestal 86 at the finished threads 118 may be 0.005 inches greater or smaller than the inner diameter D1 of the bottom portion 114.

The pedestal 86 is formed from coils or sheets of laminated metal. Alternatively, the pedestal 86 may be formed from coils of unlaminated metal. The laminated metal has a metal layer 54 of, by way of example only, steel or electrolytic tin-plated steel, and a plastic laminated layer 58 of, by way of example only, polypropylene. Thus, the metal layer 54 is located on the outer surface 94 of the pedestal 86 while the laminated layer 58 is on the inner surface 90. By way of example only, the thickness of the pedestal 86 may be in the range of 0.0160 to 0.0230 inches, with the metal layer 54 being in the range of 0.0090 to 0.0140 inches thick and the laminated layer 58 being in the range of 0.0070 to 0.0090 inches thick. Additionally, or alternatively, the outer surface 94 may include an epoxy coating or layer or an additional thin layer of laminate to protect the outer surface 94 from rusting and wear.

Alternatively, where the pedestal 86 is made of unlaminated metal, there is only the metal layer 54 which has an inner surface and an outer surface. By way of example only, the thickness of the single metal layer of the unlaminated metal pedestal 86 may be in the range of 0.0090 to 0.0180 inches thick. By way of example only, the metal layer 54 is steel or electrolytic tin plated steel.

Manufacturers increasingly desire using laminated cups to seal containers. The soft laminated bottom layer of the cup can be sealed to a container such that the cup does not need a gasket. This is an advantage because the addition of gaskets to the cups increases costs and slows down cup production. Further, the gaskets tend to come loose during shipping and handling or be blown off of the cup when the container is filled. For example, during production, containers may be filled by raising the cup off of the container and drawing a vacuum in the container and filling the container with pressurized product under the cup. During this filling process, the gaskets can be blown off of the cup and into the container.

During the forming process, the pedestal 86 is machined to form threads along the side wall 102 such that when the cup is sealed on a container, the pedestal 86 may be threadably engaged to a can tap (not shown) having corresponding threads. The can tap punctures the top wall 106 or depresses a valve to dispense the contents of the container. Depending on the contents of the container, for example refrigerant, specific threading patterns may be used on a cup pedestal 86, and the threading patterns correspond to a particular can tap.

In operation, the laminated pedestal 86 is threaded by inserting the non-threaded arbor 52 in the direction of arrow A into the interior cavity 98 to the top wall 106 of the pedestal 86 and against the laminated layer 58 of the inner surface 90 of the bottom portion 114. Alternatively, in the case of a non-laminated metal pedestal 86, the non-threaded arbor 52 is inserted into the interior cavity 98 against the inner surface of the metal layer 54 at the bottom portion 114. At the same time, the exterior threading tool 51 is positioned such that threads 53 on the exterior threading tool 51 engage the outer surface 94 (and thus the metal layer 54) of the side wall 102 of the pedestal 86 to machine threads on the pedestal 86. Any number of threading methods known in the art may be used to engage the outer surface 94. For example, an exterior threading tool may be moved about the pedestal 86 to thread the outer surface 94 or the pedestal 86 may be moved within an exterior threading tool to thread the outer surface 94. Once the threading process is complete, the exterior threading tool 51 is disengaged from the pedestal 86 and the non-threaded arbor 52 is removed from the interior cavity 98 leaving a threaded outer surface 94 and, in the case of a laminated material, a relatively smooth inner surface 90.

FIG. 7 illustrates a side sectional view of a laminated cup 50 after threading and forming. The cup 50 may have a substantially flat base 62 disposed in a central area 66 with a peripheral rim 70 being integrally connected to the base 62 by an outer wall 74. The peripheral rim 70 includes a skirt 78 that extends outward from the outer wall 74 and is concentric with the outer wall 74. A gap 82 is defined between the skirt 78 and the outer wall 74. The cup 50 further includes the cylindrical pedestal 86 formed in the central area 66.

Like the pedestal 86, the entire cup 50 is formed from coils or sheets of laminated metal. The metal layer 54 is located on a top surface 60 of the cup 50 and pedestal 86 while the laminated layer 58 is located on a bottom surface 61 of the cup 50 and pedestal 86. Alternatively, the cup 50 may be formed from a single layer of non-laminated metal and have the structure as discussed above except for having a single metal layer 54 with the top and bottom surfaces 60 and 61.

The cup 50 is used to seal a container (not shown) carrying pressurized contents, for example refrigerant products. Alternatively, the cup 50 may be a mounting cup for use in sealing aerosol containers. The cup 50 is positioned on the container such that an open neck of the container is received within the gap 82 of the peripheral rim 70 and then the cup 50 is crimped to the neck of the container.

During the threading process, as the exterior threading tool 51 (FIG. 6) deforms the metal layer 54 of the outer surface 94 to form threads 118 and the non-threaded arbor 52 (FIG. 6) engages the inner surface 90, the laminated layer 58 is compressed inside gaps 122 formed inside the threads 118. Further, the laminate is compressed within the gaps 122 to accommodate, rather than resist, the movement of the metal layer 54 and thus allows for, or facilitates, the metal layer 54 to bend instead of being extruded or thinned out by the exterior threading tool 51. For example, the laminate layer 58 is thicker in the gaps 122 and thinner at points where the metal layer 54 is pushed inward toward the inner diameter of the bottom portion 114 while the metal layer 54 of the side wall 102 maintains a generally uniform thickness throughout the threaded area. By way of example only, the thickness of the metal layer 54 may be in the range of 0.0090 to 0.0110 inches and may vary within a range of 0.0009 inches. Thus, because the laminate layer 58 allows for the metal layer 54 to be bent instead of extruded, the threads 118 are stronger than they would be if extruded and also undergo less work-hardening.

Additionally, the exterior threading tool 51 (FIG. 6) deforms the metal layer 54 (and thus the laminated layer 58) such that the top and bottom portions 110 and 114 of the pedestal 86 have a generally uniform single outer diameter defined by ends 120 of the threads 118 and a generally uniform single interior diameter defined by the generally smooth, or non-threaded, inner surface 90 of the laminate layer 58 that has been compressed between the threads 118 and the non-threaded arbor 52 (FIG. 6). For example, the outer diameter defined by the ends 120 of the threads 118 may vary within a range of 0.0009 inches and the interior diameter along the inner surface 90 may vary within a range of 0.0009 inches. Furthermore, by way of example, the inner diameter D2 defined by the inner surface 90 of the pedestal 86 at the threads 118 is approximately equal to the inner diameter D1 (FIG. 6) of the bottom portion 114 prior to machining. For example, the inner diameter D2 may be 0.005 inches larger or smaller than the inner diameter D1.

Alternatively, where the cup 50 is made of a single layer of unlaminated metal, the exterior threading tool 51 (FIG. 6) deforms the outer surface of the metal layer 54 to form threads and the non-threaded arbor 52 (FIG. 6) engages the inner surface of the metal layer 54. The exterior threading tool deforms the metal layer 54 such that the top and bottom portions 110 and 114 of the pedestal 86 have a generally uniform single outer diameter defined by the ends 120 of the threads 118. For example, the outer diameter defined by the ends 120 of the threads 118 may vary within a range of 0.0009 inches. As with the laminated cup, the metal is bent, not extruded by the process such that it maintains a generally uniform thickness throughout the threaded area. By way of example only, the thickness of the metal layer 54 may be in the range of 0.0090 to 0.0180 inches and may vary within a range of 0.0009 inches. However, without the plastic laminate layer 58, the inner surface of the pedestal 86 has the grooved, threaded pattern as shown in FIG. 7 with metal layer 54. The inner surface of the pedestal 86 at the threads 118 is less smooth than that found with a laminate because of the lack of a plastic deformable material being pushed into the gaps 122 by the non-threaded arbor 52 during the threading process. Furthermore, by way of example, the inner diameter D2 defined by the inner surface 90 of the pedestal 86 at the threads 118 is approximately equal to the inner diameter D1 (FIG. 6) of the bottom portion 114 prior to machining. For example, the inner diameter D2 may be 0.005 inches larger or smaller than the inner diameter D1.

Because the top portion 110 is structured to initially have a larger outer diameter than the bottom portion 114 prior to machining, when the metal layer 54 is deformed by the threading tool 51, the metal is displaced along the side wall 102 of the pedestal 86 such that the outer diameter of the threads 118 (along the entire side wall 102) after machining is generally the same as the outer diameter of the top portion 110 prior to machining. For example, the outer diameter defined by the threads 118 may be 0.005 inches larger or smaller than the outer diameter of the top portion 110 prior to machining. This is accomplished with either the laminated metal or the single layer of metal. Furthermore, the reduced inner diameter of the bottom portion 114 prior to threading prevents the exterior threading tool 51 from cutting into, or through, the metal layer 54 near the flat base 62 and thus results in a stronger pedestal 86.

While the cup 50 shown in the embodiments is typically used as a blind refrigerant cup, the process may be used to make a mounting cup for aerosol products or refrigerant products. For example, the non-threaded arbor may be used to form a fairly straight inner surface 90 especially for pedestals 86 having finer threads. Thus, the process may be used to produce certain fine threaded aerosol valve mounting cups with laminated bottom surfaces.

The embodiments of the invention provide several benefits. First, the threaded laminated cup and the process allows for the manufacture of a threaded cup from metal with a laminated layer on the bottom side. Specifically, the cup and process achieve a generally uniform metal layer thickness while using a non-threaded interior arbor to engage the laminated bottom surface layer and maintain a fairly smooth, straight inner pedestal surface. A cup with a laminated bottom surface does not need a gasket in order to be sealed to a container because the soft laminate material engages the container during the sealing process to form a tight seal. This is a significant advantage because gaskets cost more in extra materials and cost more in time and money to add to the cup during production. Additionally, when a container is being filled under the cup during the filling process, the gaskets often is blown out of the cup, which slows down production. Also, gaskets often do not form a good seal with the container and therefore can cause the container to leak. Therefore, the ability to use a laminated threaded cup without a gasket significantly improves production speed and product quality for cups. Additionally, the inert plastic laminate material may be more compatible with contents in the container than a rubber gasket.

Also, the structure of the pedestal prior to threading, with the top portion having a greater diameter than the bottom portion, and the threading method used on the cup results in a threaded cup having generally uniform metal layer thickness. Thus, the threads are as strong or stronger than those found on pedestals formed from thicker metal and having non-uniform metal layer thickness. Additionally, by bending the metal to maintain a uniform thickness of the metal layer, instead of extruding and squeezing it, a thinner metal layer may be used for different thread depths. By being able to make the cup out of a thinner layer of metal, the machines used to clinch or crimp the cups to the containers undergo less resistance and wear, which, in turn, results in less down time and less need for replacement parts.

Another benefit of the invention is that thread appearance is improved as a generally uniform wall thickness is maintained throughout the threaded area of the pedestal. The side wall of the pedestal is not work hardened or stressed as it would be with a standard non-threaded arbor where the metal is extruded and squeezed; therefore the thread strength is comparable to that of threaded cups made of thicker raw materials.

Another benefit of the invention is that the inner plastic laminate layer can act as a barrier to leakage if the thread is cross-threaded or broken. This inner plastic laminate layer helps provide an extra margin of safety against the leaking or bursting of the finished container assembly.

Another benefit of the invention is that it provides a way to produce thin-walled laminate or non-laminate cups without the need for a threaded inner arbor. This eliminates the need to maintain perfect alignment between a threaded inner arbor and the outer threading device.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A method for forming a threaded laminated cup for use in sealing a container, comprising:

forming a pedestal of a cup, wherein said forming comprises providing the pedestal with a first plastic laminated layer and second metal layer, an interior cavity having an inner surface, and a top portion that has a larger diameter than a bottom portion;

inserting a non-threaded arbor into the interior cavity to engage the inner surface of the bottom portion; and engaging the second layer with a threading tool, wherein said engaging comprises deforming the metal of the second layer into threads, and compressing the plastic laminate of the first layer between the threads and the non-threaded arbor such that the second layer maintains a generally uniform thickness along the threads.

2. The method of claim 1, wherein the inner surface along the top and bottom portions is non-threaded after said engaging step.

3. The method of claim 1, wherein the first layer is polypropylene.

4. The method of claim 1, wherein the second layer is steel.

5. The method of claim 1, wherein prior to said inserting step, the first layer has a thickness within the range of 0.0070 inches to 0.0090 inches.

6. The method of claim 1, wherein prior to said inserting step, the second layer has a thickness within the range of 0.0090 inches to 0.0140 inches.

7. The method of claim 1, wherein prior to said inserting step, the first and second layers combined together have a thickness within the range of 0.0160 inches to 0.0230 inches.

8. The method of claim 1, wherein prior to said inserting step, the bottom portion has an inner diameter that is approximately equal to an inner diameter of the pedestal at the threads after said engaging step.

9. The method of claim 1, wherein the pedestal has a side wall and prior to said inserting step, the side wall has generally the same thickness at the bottom portion and the top portion.

10. The method of claim 1, wherein said pedestal has a top wall, wherein during said inserting step, the non-threaded arbor extends to, and engages, the first layer along the top wall.

11. The method of claim 1, wherein the threading tool engages the second layer of the pedestal by being moved about the second layer to thread the second layer.

12. The method of claim 1, wherein, during said engaging step, the first layer is compressed within gaps formed inside the threads of the second layer and allows the second layer to be bent by the threading tool.

13. The method of claim 1, wherein, after said engaging step, the top and bottom portions have a generally uniform outer diameter at the threads.

14. The method of claim 1, wherein, after said engaging step, the top and bottom portions have a generally uniform inner diameter along the inner surface.

15. A laminated cup for use in sealing a container, comprising:

a base having a pedestal and an outer wall extending therefrom, said pedestal defining an interior cavity with an inner surface and having an inner first layer and an outer second layer and being formed of a plastic laminated metal material such that said first layer is plastic laminate and said second layer is metal, said second layer having an inner side disposed along said first layer, wherein said second layer has threads and has a generally uniform thickness at said threads, said threads defining gaps therebetween along said inner side of said second layer and said laminate of said first layer filling said gaps such that said inner surface of said pedestal is non-threaded.

16. The laminated cup of claim 15, wherein said first layer is polypropylene.

17. The laminated cup of claim 15, wherein said second layer is steel.

18. The laminated cup of claim 15, wherein said cup includes a peripheral rim intergrally connected to said base by an outer wall, said outer wall having a skirt, said cup receiving said container between said outer wall and said skirt such that said cup is sealable about said container.

19. The laminated cup of claim 15, wherein said threads are configured such that said pedestal may be threadably engaged to a can tap having corresponding threads.

20. The laminated cup of claim 15, wherein said pedestal has a generally uniform outer diameter at said threads.

21. The laminated cup of claim 15, wherein said pedestal has a generally uniform inner diameter along said inner surface.

22. A method for forming a threaded laminated cup for use in sealing a container, comprising:

forming a pedestal of a cup, wherein said forming comprises providing the pedestal with a first plastic laminated layer and second metal layer, an interior cavity having an inner surface and a top wall, and a top portion that has a larger diameter than a bottom portion;

inserting a non-threaded arbor into the interior cavity to engage the first layer along the top wall and the inner surface at the bottom portion; and engaging the second layer with a threading tool, wherein said engaging comprises moving the threading tool about the second layer to deform the metal of the second layer into threads, and compressing the plastic laminate of the first layer into gaps formed between the threads and the non-threaded arbor such that the first layer allows the second layer to be deformed by the threading tool and maintain a generally uniform thickness along the threads while the inner surface along the top and bottom portions remains non-threaded.

23. A method for forming a threaded cup for use in sealing a container, comprising:

forming a pedestal of a cup, wherein said forming comprises providing the pedestal with an inner surface and an outer surface, a metal layer, an interior cavity and a top portion that has a larger diameter than a bottom portion;

inserting a non-threaded arbor into the interior cavity to engage the inner surface along the bottom portion; and engaging the outer surface with a threading tool, wherein said engaging comprises displacing the metal layer along the top portion towards the non-threaded arbor and deforming the metal layer into threads, such that the metal layer maintains a generally uniform wall thickness along the threads.

24. The method of claim 23, wherein the metal layer is steel.

25. The method of claim 23, wherein the metal layer has a thickness within the range of 0.0090 inches to 0.0180 inches.

26. The method of claim 23, wherein prior to said inserting step, the bottom portion has an inner diameter that is approximately equal to an inner diameter of the pedestal at the threads after said engaging step.

27. The method of claim 23, wherein the pedestal has a side wall and prior to said inserting step, the side wall has generally the same thickness at the bottom portion and the top portion.

28. The method of claim 23, wherein the threading tool engages the metal layer of the pedestal by being moved about the outer surface of the metal layer to thread the metal layer.

29. The method of claim 23, wherein, after said engaging step, the top and bottom portions have a generally uniform outer diameter at the threads.

* * * * *